United States Patent [19]

Karpanty

[11] 4,363,152

[45] Dec. 14, 1982

[54] SQUEEGEE ASSEMBLY FOR A SCRUBBING MACHINE

[75] Inventor: David J. Karpanty, Toledo, Ohio

[73] Assignee: The Scott & Fetzer Company, Lakewood, Ohio

[21] Appl. No.: 235,436

[22] Filed: Feb. 19, 1981

[51] Int. Cl.[3] ..... A47L 7/00

[52] U.S. Cl. ..... 15/98; 15/50 R; 15/320; 15/340

[58] Field of Search ..... 15/50 R, 50 C, 98, 99, 15/50 A, 51, 52, 320, 321, 340

[56] References Cited

U.S. PATENT DOCUMENTS 4,037,289 7/1977 Dojan ..... 15/320

*Primary Examiner*—Edward L. Roberts

*Attorney, Agent, or Firm*—Allen D. Gutchess, Jr.

[57] ABSTRACT

A squeegee assembly is provided for a scrubbing machine. The squeegee assembly is mounted in a manner such that it can separate from the machine to avoid damage in the event the assembly encounters a stationary object. The mounting arrangement includes a mounting plate which can be raised and lowered. The squeegee assembly is frictionally connected to the mounting plate so as to move therewith and be supported thereby but so that the squeegee assembly can separate rearwardly relative to the mounting plate to prevent damage. The squeegee assembly includes a squeegee blade supporting member with quick-release bands. The bands clamp a squeegee blade between the supporting member and the bands with the squeegee blade requiring no special attaching provisions at all, not even mounting holes. The bands have quick-release latches so that the blades can be easily and quickly removed and replaced, when necessary.

12 Claims, 8 Drawing Figures

SQUEEGEE ASSEMBLY FOR A SCRUBBING MACHINE

This invention relates to a squeegee assembly for a scrubbing machine or the like.

A squeegee assembly for a scrubbing machine is generally mounted on the rear of the machine to pick up cleaning solution from the surface being cleaned, the solution being supplied to the surface through or near rotary scrub brushes located under the machine toward the front. The squeegee assembly includes a squeegee supporting member of generally arcuate or shallow V-shaped configuration with spaced squeegee blades depending therefrom and in contact with the surface. A vacuum source communicates with a vacuum chamber formed between the blades to pick up the dirty cleaning solution and carry it to a tank which is subsequently emptied. The squeegee assembly must be sufficiently long to fully cover the width of the path of the scrub brushes. Consequently, the ends of the squeegee assembly tend to be exposed at the sides of the machine and are potentially vulnerable to stationary objects which might be encountered during the scrubbing operation. Heretofore, rollers and similar devices have been used in an attempt to protect the ends of the squeegee assembly but these were not always effective against all sizes and shapes of objects which might be encountered. Consequently, solid contact between an end of a squeegee assembly and a stationary object would occasionally occur and result in substantial damage to the squeegee assembly.

Also, with scrubbing machines heretofore commonly known, it has been difficult to replace the squeegee blades, which must be done with a degree of regularity since the lower edges of the blades are in constant contact with the surface being cleaned, with a resulting inevitable degree of wear. The squeegee assembly usually has had a plurality of fasteners which attach the squeegee blades to the support or frame. Consequently, replacement of the blades was time consuming and resulted in using a substantial amount of labor. Also, the blades had to be manufactured with accurately spaced holes or special shapes in order to accommodate the fasteners of the attaching means. While to a limited extent, clamping bands have been employed with squeegee assemblies to attach the squeegee blades, these have been generally difficult to manipulate and usually required two people to replace the blades.

The present invention provides a scrubbing machine with a squeegee assembly which is releasably connected to the machine. More specifically, the squeegee assembly is releasably connected to a mounting plate which is movably carried by the machine so as to be raised and lowered, to raise and lower the squeegee assembly toward and away from the surface being cleaned. If the squeegee assembly, and particularly an end thereof, should strike a stationary object, the squeegee assembly will then become disconnected from the mounting plate as the scrubbing machine continues to move forwardly, thereby preventing damage to the squeegee assembly.

In a preferred form, the squeegee assembly is connected to the mounting plate by ears having open ended slots with the ears engaged by threaded shanks and nuts which preferably can be tightened or loosened by hand. The squeegee assembly is thereby frictionally held so as to be functionally integral with the mounting plate yet released therefrom when encountering an object. A vacuum hose for the squeegee assembly can also be flexible and extendable so as to remain connected therewith if the assembly has separated from the mounting plate.

The new squeegee assembly of the scrubbing machine also embodies a quick-release attaching mechanism for attaching a squeegee blade to an elongate supporting member of the squeegee assembly. For this purpose, two clamping bands extend along a vertical surface of the supporting member, with each band having a quick-release latch at one end and connected to an end portion of the supporting member; the bands also have overlapping end portions at a central portion of the supporting member. The overlapping end portions of the clamping bands are mounted on slanted pins which urge those end portions of the bands outwardly away from the supporting member when the quick-release latches move the opposite ends of the bands outwardly and in directions toward one another. Similarly, the slanted pins are effective to move the bands toward the elongate supporting member when the quick-release latches are moved in the opposite directions to move the bands inwardly and in directions away from one another. In the first position, the bands are spaced from the elongate supporting member throughout their length to enable the squeegee blade to be easily removed. In the second position, the bands exert uniform pressure against a squeegee blade to hold the blade firmly engaged between the bands and the elongate supporting member. With this design, the squeegee blades can be removed and replaced in minimal time and this can be accomplished by one person. In addition, the blades require no special holes or particular shapes of any sort but can simply be long flexible strips of rubber or the like with parallel edges and without openings. This thereby substantially reduces the manufacturing costs of the squeegee blade.

It is, therefore, a principal object of the invention to provide a squeegee assembly for a scrubbing machine which is releasably carried by the scrubbing machine to separate therefrom if a stationary object is encountered by the assembly.

Another object of the invention is to provide a squeegee assembly for a scrubbing machine which is releasably connected to a mounting plate of the machine through fasteners which are frictionally adjustable.

A further object of the invention is to provide a squeegee assembly for a scrubbing machine in which the assembly can be releasably connected to the machine and a squeegee blade can be rapidly removed and replaced.

Yet another object of the invention is to provide a squeegee assembly with clamping bands for releasably clamping a squeegee blade to an elongate supporting member, which bands can move substantially uniformly toward and away from the elongate supporting member throughout their length.

Still a further object of the invention is to provide a squeegee assembly for a scrubbing machine by means of which a squeegee blade can be quickly removed and can be quickly replaced by another blade through the use of two mounting bands having quick-release latches connecting ends of the bands to an elongate supporting member of the squeegee assembly.

Many other objects and advantages of the invention will be apparent from the following detailed description of a preferred embodiment thereof, reference being made to the accompanying drawings, in which.

Figure 1:
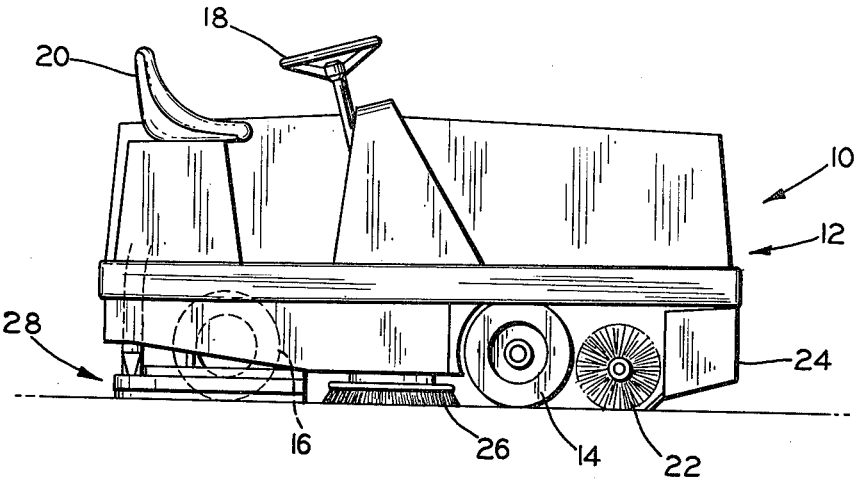
FIG. 1 is a somewhat schematic side view in elevation of a surface cleaning machine embodying the invention.

Referring to FIG. 1, a surface cleaning machine embodying the invention is indicated at 10. The machine shown actually is a combination scrubbing and sweeping machine, although this is irrelevant insofar as the present invention is concerned. The machine 10, as shown, includes a main body or frame 12 with front intermediate wheels 14 and a single rear wheel 16 which steers the machine through a steering wheel 18 located in front of an operator's seat 20. In this instance, a rotary drum broom 22 is located near the front of the machine and sweeps dirt and debris from the surface being cleaned into a front hopper 24. Behind the wheels 14, three rotary disc brushes 26 are located in a known, staggered relationship so that the path covered by each of the brushes 26 slightly overlaps the path of the adjacent brush or brushes. The combined path of the scrubbing brushes extends substantially over the width of the machine 10. Cleaning solution from a first supply tank (not shown) located at the upper forward portion of the machine can be supplied to the surface being cleaned, either through or near the brushes 26, as is known in the art. A substantial portion of the solution deposited on the surface is then picked up by a rear squeegee assembly 28. The dirty solution is carried to a second tank (not shown) located at the upward forward portion of the machine 10 which is emptied from time to time.

Figure 2:
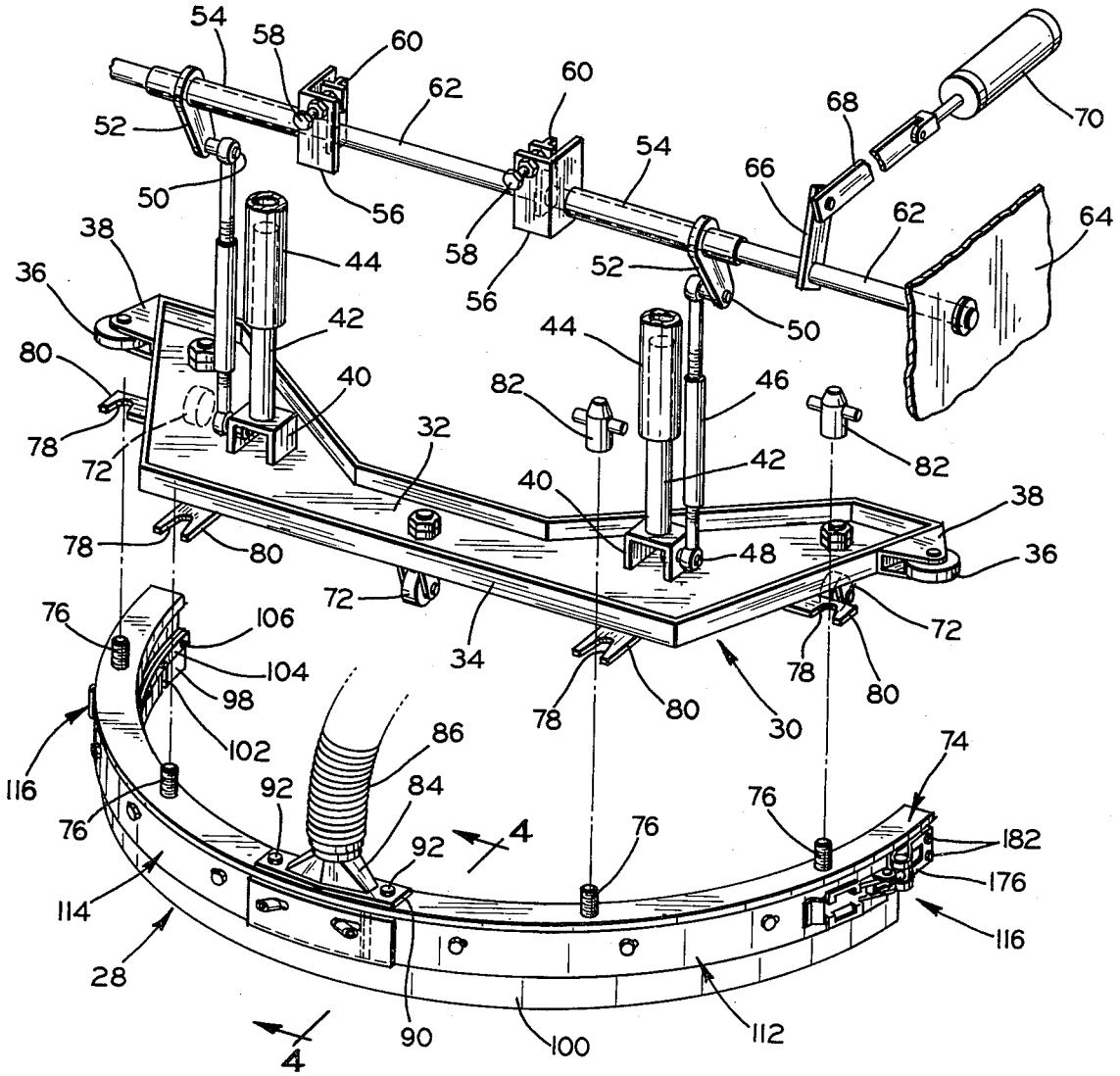
FIG. 2 is an enlarged, exploded view in perspective of a squeegee assembly and a mounting plate used with the machine of FIG. 1.

Referring to FIG. 2, the squeegee assembly 28 is releasably connected to connecting means for carrying the assembly by the machine and for raising and lowering the assembly relative to the machine. More specifically, the connecting means includes a mounting member or plate 30 which is carried by the machine 10 for vertical movement in order to raise and lower the squeegee assembly 28 during cleaning operations and for transporting purposes. The mounting plate 30 can also float relative to the machine 10 to enable the squeegee assembly 28 to remain fully in contact with surfaces being cleaned, even though they are somewhat irregular or uneven.

The mounting member 30 includes a main plate 32 and edge stiffening flanges 34. Protective rollers 36 extend outwardly from the opposite ends of the mounting member 30, being carried by brackets 38 affixed to the stiffening flanges 34. The rollers 36 are designed to protect the extremities of the squeegee assembly 28 from stationary objects, the ends of the squeegee assembly 28 being vulnerable since they are close to the edge of or even extend beyond the machine. This is necessary for the squeegee blade to contact the entire path of the scrub brushes 26. However, a stationary object of low profile can occasionally pass under one of the rollers 36 and solidly contact one of the ends of the squeegee assembly 28. Heretofore, substantial damage to the squeegee assembly could and sometimes did result from such contact.

The mounting member 30 also has inverted U-shaped brackets 40 affixed to the mounting plate 32 with guide rods 42 extending upwardly therefrom. The guide rods 42 extend through tubular guides 44 which are suitably supported in a rear portion of the machine body 12 and guide the mounting plate 32 in its up and down movement. The mounting member 30 and the squeegee assembly 28 are in a lower position during a cleaning operation and are in a raised position when the machine is simply traveling from one location to another.

To raise and lower the mounting member 30 and the squeegee assembly 28, adjustable links 46 are pivotally connected to the inverted U-shaped brackets 40 by pins 48 and have upper ends pivotally connected by pins 50 to crank arms 52. The crank arms 52 are affixed, as by welds, to tubular shafts 54 which, in turn, are affixed to angular stops 56 having adjusting screws 58. When the mounting member 30 and the squeegee assembly 28 are in the lowermost position with the blades of the assembly 28 in full contact with the surface being cleaned, the adjusting screws 58 are spaced slightly from lift arms 60 to enable the squeegee assembly 28 to float. The arms 60 are affixed to a solid shaft 62 which extends through the tubular shafts 54 and is supported at its ends by suitable side panels 64 to the machine body 12. The solid shaft 62 can be turned by a drive arm 66 keyed or otherwise affixed thereto and pivotally connected by a link 68 to a fluid-operated or electro-mechanically operated ram 70 suitably located in the machine. The elements 46–70 along with the mounting member 30 comprise the connecting means for carrying the squeegee assembly 28 by the machine and for raising and lowering the squeegee assembly relative to the machine.

During a scrubbing operation, the squeegee assembly 28 and the mounting member 30 are free to float up and down relative to the machine, with the rods 42 being guided in the guide sleeves 44. During such movement, the links 46 will also move up and down somewhat to turn the tubular shafts 54 and the angular stops 56. In such an instance, the adjusting screws 58 move toward and away from the lift arms 60, the screws being adjusted so that even in the lowermost position of the mounting member 30, the screws will still be spaced from the arms 60. This condition occurs when the cylinder rod of the fluid-operated ram 70 is fully retracted. When in the lowermost position, three casters 72 engage the surface being cleaned to support a substantial portion of the weight of the squeegee assembly 28 and the mounting member 30.

When it is desired to raise the mounting member 30 and the squeegee assembly 28 as when the machine is moving from one location to another, the fluid-operated ram 70 is actuated to move the link 68 and the arm 66 and then to move the solid shaft 62 in a counterclockwise direction, as viewed in FIG. 2. The lift arms 60 will thus move in the same direction and engage the screws 58. The angular stops 56 will then similarly be moved and thus rotate the shafts 54 and the crank arms 52. These will raise the links 46 which will raise the mounting member 30 and the squeegee assembly 28 to a position well clear of the surface that has been cleaned and any other surfaces over which the machine passes when moving to another location.

Figure 3:
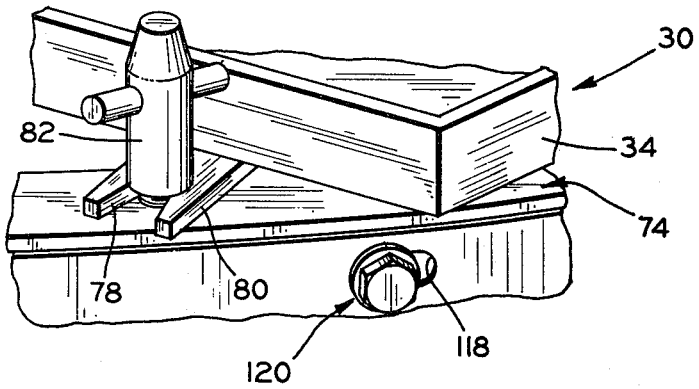
FIG. 3 is a further enlarged view in perspective of a portion of the squeegee assembly and a portion of the mounting plate showing means by which the assembly is releasably connected to the plate.

To avoid the aforesaid damage to the squeegee assembly 28, an elongate supporting member 74 of the squeegee assembly 28 has, in this instance, four vertically-extending threaded studs or shanks 76. These are received in divergent, open-ended slots 78 (FIGS. 2 and 3) in ears 80 which extend outwardly from the mounting plate 32, with all of the slots 78 opening rearwardly. With the studs 76 received in the slots 78, tightenable nuts 82, which can be in the general form of wing nuts, are turned downwardly on the studs 76 to frictionally engage the upper and lower surfaces of the ears 80 between the lower edges of the nuts 82 and the upper surface of the elongate supporting member 74 of the squeegee assembly. The degree of tightening of the nuts 82 on the studs can be controlled to determine the degree of the friction fit between the squeegee assembly 28 and the mounting member 30. In the event an end portion or any other portion of the squeegee assembly 28 then encounters a stationary object, the studs 76 will move out of the open ends of the slots 78, carrying the wing nuts 82, and rest on the floor in contact with the stationary object as the machine 10 moves forwardly a short distance until it can be stopped.

The supporting member 74 of the squeegee assembly 28 has an exhaust fitting 84 extending upwardly from a central portion thereof and receives an end of a vacuum hose 86 which communicates with the second tank of the machine. The end of the hose 86 is received over the fitting 84 and is held by a suitable clamping band 88. The vacuum hose can stretch about two to three feet if the squeegee assembly 28 becomes separated from the machine 10 and drops to the floor, giving the operator sufficient time to stop the machine. The matter of reassembling the squeegee assembly 28 and the mounting member 30 is then a relatively simple procedure.

Figure 4:
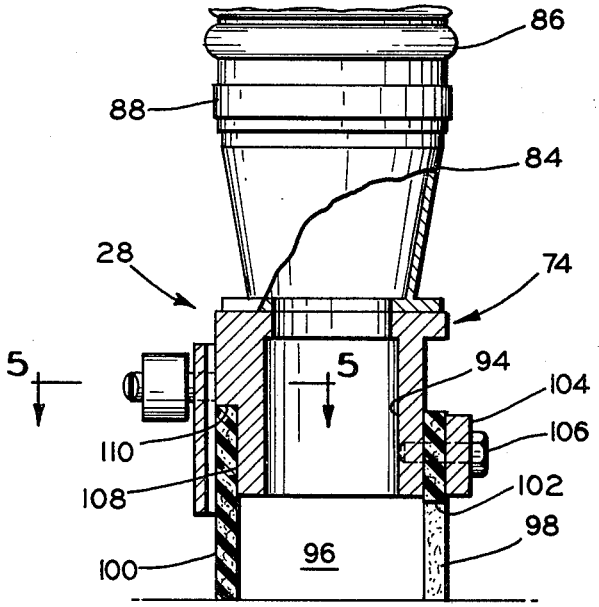
FIG. 4 is an enlarged view in transverse cross section taken along the line 4—4 of FIG. 2.

The fitting 84 has a flange 90 which is attached to a central portion of the supporting member 74 by suitable fasteners 92. The fitting 84 communicates with a vacuum passage 94 which extends through the member 74 and communicates with a vacuum chamber 96 extending the length of the supporting member and being defined by a front squeegee blade 98 and a rear squeegee blade 100. The blades 98 and 100 are spaced more closely together toward the forward ends of the supporting member 74 so that the vacuum chamber 96 is smaller toward those ends. At the ends of the member, the blades 98 and 100 almost touch in order to close off the chamber. The front blade 98 has slits 102 (FIG. 4) therein to facilitate the entry of air and cleaning solution to the chamber 96, with an upper continuous portion of the blade 98 being held against the supporting member 74 by a band 104 and fasteners 106. This blade is preferably made of a material such as urethane which wears slowly and needs replacement less often than the blade 100. Hence, the blade 98 has more or less conventional attaching means.

Figure 5:
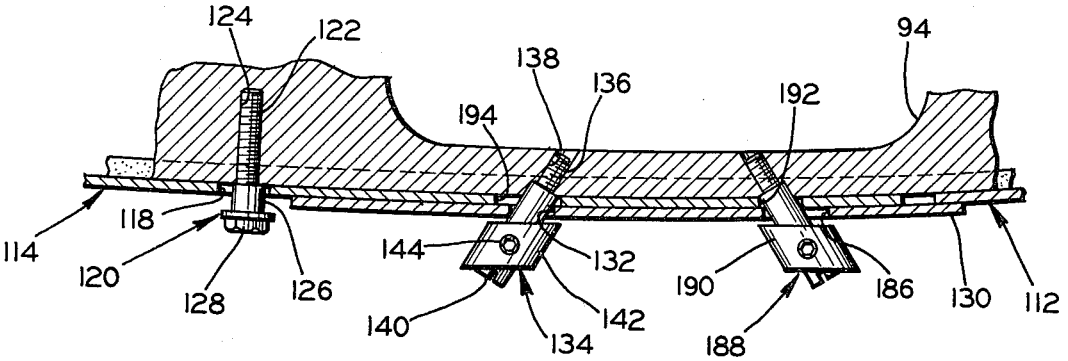
FIG. 5 is a fragmentary view in horizontal cross section taken along the line 5—5 of FIG. 4.
Figure 6:
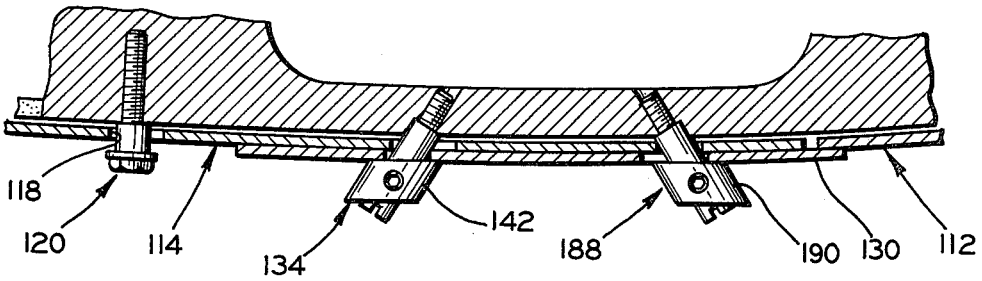
FIG. 6 is a view similar to FIG. 5 but with clamping bands shown in a different position.

The rear squeegee blade 100 preferably is of lower cost rubber or the like which wears somewhat faster than the blade 98. The rear blade 100 is continuous throughout its entire length, requiring no special shapes or slots or holes for mounting fasteners. The upper edge of the blade 100 seats against a recessed surface 108 of the supporting member 74 with the upper edge abutting a shoulder 110 of the member. The surface 108 preferably is roughened, as by being rough cast or having a aluminum oxide coating, for example, to aid in holding the blade 100. The blade 100 is clamped in position by two clamping or quick-release bands 112 and 114. These bands 112 and 114 can be quickly moved between a clamping position, as shown in FIG. 5 and a release position, as shown in FIG. 6, by end latches 116 (FIGS. 7 and 8) located at forward, outer ends of the bands 112 and 114.

Each of the bands 112 and 114 has slots 118 (FIGS. 3, 5, and 6) which receive shoulder bolts 120 having threaded shanks 122 turned into tapped holes 124 in the supporting member 74. The bolts 120 have shanks 126 which extend through the slots 118 and outer heads 128 which limit the extent to which the bands can move outwardly from the supporting member 74.

In this instance, the band 112 has an offset portion 130 (FIGS. 5 and 6) so that the rear inner end portion thereof can overlap the rear, inner end portion of the band 114. As shown, the offset is achieved by using two separate band portions which are spot welded or otherwise suitably affixed together. However, the offset can also be formed by a bend in the band 112 or by other suitable means. The rear end of the band 112 has a hole or opening 132 therein which receives a slanted means or pin 134 slanting away from the forward end of the band 112 with the release latch 116. The slanted pin 134 has a threaded shank 136 turned into a tapped opening 138 in the supporting member 74, with the pin 134 having a slot 140 in the outer end for this purpose. A collar 142 is mounted on the pin 134 by a set screw 144 with the collar shaped so that the inner surface is parallel to the end of the band 112. The collar 142 limits the outward movement of the band 112 when in its release position, as shown in FIG. 6. With the band in its inner, clamping position, as shown in FIG. 5, the left edge of the hole 132 engages the corresponding surface of the pin 134, thereby forcing the band inwardly to clamp the right hand portion (as viewed from the rear) of the rear squeegee blade 100 in position against the surface 108. The other end of the clamping band 112 is held in its clamping position by the quick-release latch 116, when in the position of FIG. 7.

The quick-release latch 116 is basically a commercially-available one with some slight modifications. The band includes a base plate 146 which is affixed to the end of the band 112 by suitable means, such as welding, with a pair of ears 148 extending outwardly from one end portion of the plate 146 and a projection 150 extending outwardly from the other end of the plate. An over-center lever 156 has two legs 158 which are pivotally connected to the ears 148 by pins 160 with a bridging handle plate 162 connecting other portions of the legs 158. A suitable safety catch 164 is pivotally mounted on the lever 156 and engages the projection 150 when the quick-release latch 116 is closed to prevent accidental opening thereof and possible release of the squeegee blade 100.

The latch 116 also has a connecting rod 166 with an enlarged head 168 which is pivotally connected by a pin 170 to intermediate portions of the lever legs 158. The opposite end of the connecting rod 166 is threaded at 172 and extends through a threaded bore in a cylindrical body 174 for adjusting purposes. The body 174 is pivotally held by a mounting band 176 which is affixed to a mounting block 178. The block 178 is, in turn, affixed to an offset portion 180 at the outer end of the supporting member 174 by fasteners 182 (also see FIG. 2).

Figure 7:
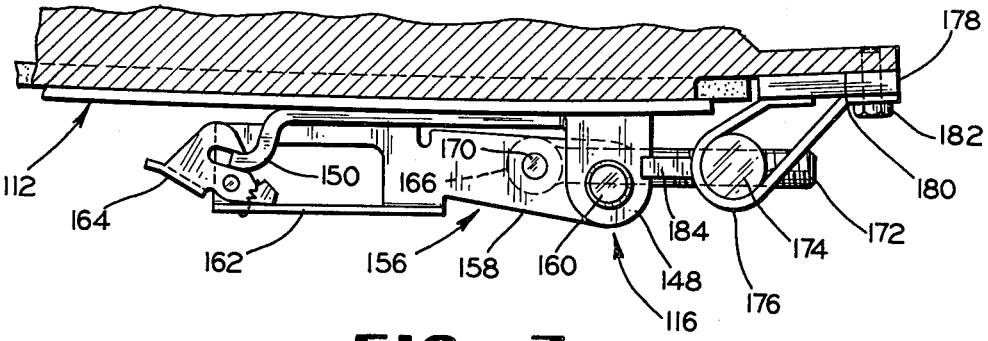
FIG. 7 is a fragmentary plan view, partly in cross section, of a quick-release latch shown in FIG. 2.

When the quick-release latch 116 is in the closed position of FIG. 7, a line drawn through the center of the pin 170 and the cylindrical body 174 extends inwardly of the center of the pins 160. Thus, the latch 116 tends to be held in the closed position when the band 112 is in the clamping position and under tension, with the catch 164 engaged with the projection 150 for safety purposes.

Figure 8:
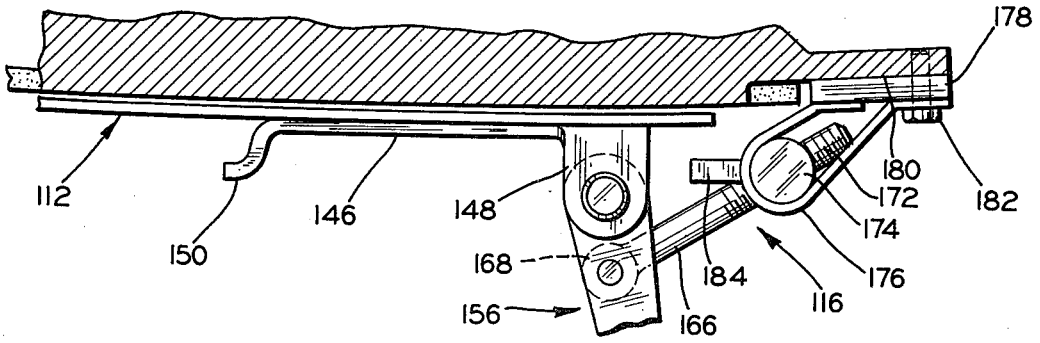
FIG. 8 is a fragmentary view of the latch of FIG. 7, shown in a different position.

When the lever 156 is partially open, to the position of FIG. 8, the band 112 is moved rearwardly and toward the band 114. This causes the right edge of the hole 132 to ride up on the slanted pin 134, as shown in FIG. 6, to force the band 112 away from the supporting member 74. Thus, the band moves away from the supporting member and away from the rear squeegee blade 100. When the quick-release latch 116 is thus moved, extending tabs 184 on the mounting bend 176 limit the extent to which the forward end portion of the band 112 can move outwardly. This assures that the band 112 will move rearwardly, toward the band 114 to assure that the band will move up and outwardly on the slanted pin 134.

The band 112 also has an elongated slot 186 which receives another slanted means or pin 188 but the band 112 does not contact that pin except for a collar 190 thereon which helps limit the extent to which the band 112 can move outwardly. Similarly, the slots 118 in the band 112 do not contact the shoulder bolts 120 with those bolts being functional only to limit the outward movement of the band by means of the bolt heads 128. The outward movement of the band 112 is thus controlled, with the band 114 being similarly controlled. This facilitates the release and replacement of the squeegee blade 100 by only one operator.

The band 114 functions similarly to the band 112. The band 114 has a round hole or opening 192 in the rear end portion through which the slanted pin 188 extends. The pin and hole cooperate to force the band 114 inwardly to the clamping position when the band 114 is moved away from the band 112, as viewed in FIGS. 5 and 6 by its quick-release latch 116. Similarly, the band 114 is forced outwardly by the pin 188 when the band is moved rearwardly toward the band 112. The band 114 also has an elongate slot 194 which clears the pin 134 and is not affected thereby. The outward movement of the band 114 is limited by the outward movement of the band 112 which, in turn, is limited by the collars 142 and 190. The latch 116 for the band 114 is the same as that of FIGS. 7 and 8 and operates in the same manner. That latch also has the tabs 184 to control outward movement of the forward, outer end of the band 114.

From the above, it will be seen that the bands 112 and 114 can be moved quickly between their clamping and release positions by the latches 116 and the bands are supported and limited in movement such that the squeegee blade 100 can be removed and reinserted or replaced by one operator in a short period of time.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Squeegee apparatus for a scrubbing machine comprising a squeegee supporting member, means for connecting said squeegee supporting member to said machine, said squeegee supporting member having forward outer end portions and a rear intermediate portion, said supporting member having a downwardly-extending rear wall, a squeegee blade which is substantially continuous and uninterrupted from one end to another, two clamping bands extending along the rear wall of said supporting member and having inner ends near the rear intermediate portion of said supporting member and having outer ends near the forward outer end portions of said supporting member, means located at the rear intermediate portion of said supporting member and cooperating with inner end portions of said clamping bands for moving said bands toward said rear wall when said bands are moved toward said forward outer end portions of said supporting member, and means engagable with outer end portions of both of said clamping bands near said forward outer end portions of said supporting member for moving said outer end portions of said bands transversely toward said supporting member and toward said forward outer end portions of said supporting member, whereby said clamping bands hold said squeegee blade against said rear wall when said clamping bands are so moved by said engagable means.

2. Squeegee apparatus according to claim 1 characterized by said last-named means being over-the-center, quick-release latch means.

3. Squeegee apparatus according to claim 2 characterized by said latch means having means for limiting the extent to which the forward end portions of said bands can move transversely away from said supporting member.

4. Squeegee apparatus according to claim 1 characterized by said means cooperating with inner end portions of said bands comprising two slanted pins slanting away from one another and supported by said supporting member and said clamping bands having openings through which said slanted pins extend.

5. A squeegee assembly according to claim 1 characterized by a plurality of shoulder bolts or the like extending outwardly from said squeegee supporting member, and said bands having slots through which said shoulder bolts extend.

6. Squeegee apparatus according to claim 1 characterized by releasable means for attaching said squeegee supporting member to said connecting means to enable said supporting member and said connecting means to separate if a stationary object is encountered.

7. Squeegee apparatus according to claim 6 characterized by said releasable means comprising means forming open ended notches on one of said supporting member and said connecting means, shanks on the other of said supporting member and said connecting means, and means frictionally engaging said shanks and said notch means.

8. Squeegee apparatus according to claim 7 characterized by said last-named means comprising nut means threadedly engaging said shanks and said notch means.

9. Squeegee apparatus for a scrubbing machine comprising a squeegee supporting member, a squeegee carried by said supporting member, connecting means for supporting said supporting member below said scrubbing machine and for raising and lowering said supporting member, releasable means for releasably connecting said squeegee supporting member and said connecting means for releasably connecting said squeegee supporting member to said scrubbing machine to enable said supporting member to be releasably separated from the machine if a stationary object is encountered, said releasable means comprising means forming open ended notches carried by one of said supporting member and said connecting means, shanks on the other of said supporting member and said connecting means, and means frictionally engaging said shanks and said notch-forming means.

10. Squeegee apparatus according to claim 9 characterized by said last-named means comprising said shanks being threaded, and nuts threadedly engaging said shanks and said notch-forming means.

11. Squeegee apparatus for a scrubbing machine comprising an elongate squeegee supporting member, a squeegee blade which is substantially continuous and uninterrupted from one end to another, connecting means for supporting said supporting member below the machine and for raising and lowering the member, means for releasably connecting said squeegee supporting member and said connecting means to enable said squeegee supporting member to separate from said connecting means without damage if said supporting member encounters a stationary object, said squeegee supporting member having a downwardly-extending rear wall, a first clamping band which extends along said rear wall from one end thereof to a central portion thereof, a second clamping band which extends along said rear wall from the other end to the central portion thereof, slanting means attached to said supporting member at the central portion thereof and having oppositely-extending slanted surfaces, and engagable means on said clamping bands at portions adjacent said central portion of said rear wall and engagable with said slanting means, and latch means connecting end portions of said clamping bands spaced from the portions adjacent said central portion of said rear wall for moving said bands in directions away from said central portion of said rear wall and transversely toward said supporting member with the portions of said clamping bands adjacent said central portion being urged transversely toward said supporting member by engagement of said engageable means with said slanting means to clamp said squeegee blade between said bands and said rear wall.

12. Squeegee apparatus according to claim 11 characterized by said releasable connecting means comprising means forming open ended notches on one of said connecting means and said squeegee supporting member and means carried by the other of said connecting means and said squeegee supporting member for frictionally engaging said notch-forming means.

* * * * *